US008353400B2

(12) United States Patent
Santy et al.

(10) Patent No.: US 8,353,400 B2
(45) Date of Patent: Jan. 15, 2013

(54) LAPTOP COMPUTER CASE AND SPRING PROTECTION SYSTEM

(75) Inventors: Dirk Santy, Koekelar (BE); Donald John Wilson, London (GB)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 615 days.

(21) Appl. No.: 12/522,156

(22) PCT Filed: Jan. 4, 2008

(86) PCT No.: PCT/US2008/050241

§ 371 (c)(1),
(2), (4) Date: Jul. 3, 2009

(87) PCT Pub. No.: WO2008/086186

PCT Pub. Date: Jul. 17, 2008

(65) Prior Publication Data

US 2009/0294235 A1 Dec. 3, 2009

Related U.S. Application Data

(60) Provisional application No. 60/878,756, filed on Jan. 5, 2007.

(51) Int. Cl.
*A45C 5/00* (2006.01)
*A45C 13/02* (2006.01)

(52) U.S. Cl. ..... 206/320; 206/521; 206/523; 190/36; 190/102

(58) Field of Classification Search ..... 190/36, 190/13 C, 100, 102; 206/320, 521, 521.6, 206/591, 521.8, 293, 817; 220/720, 920, 559; 224/642
See application file for complete search history.

(56) References Cited

U.S. PATENT DOCUMENTS

| | | | | |
|---|---|---|---|---|
| 1,892,527 | A | | 3/1929 | Gray |
| 2,393,349 | A | | 1/1946 | Weingarten |
| 3,445,051 | A | * | 5/1969 | Goldman ..... 206/521 |
| 5,010,988 | A | | 4/1991 | Brown |
| 5,139,838 | A | * | 8/1992 | Baum ..... 428/72 |
| 5,494,157 | A | | 2/1996 | Golenz |
| 5,570,780 | A | * | 11/1996 | Miller ..... 206/305 |
| 5,623,390 | A | * | 4/1997 | Noda et al. ..... 361/679.02 |
| 5,810,171 | A | * | 9/1998 | Lee ..... 206/523 |
| 5,884,768 | A | * | 3/1999 | Fox ..... 206/522 |
| 5,909,806 | A | * | 6/1999 | Fischel et al. ..... 206/320 |

(Continued)

FOREIGN PATENT DOCUMENTS

JP 2000232271 A 8/2000

*Primary Examiner* — Sue Weaver
(74) *Attorney, Agent, or Firm* — Dorsey & Whitney LLP

(57) ABSTRACT

A lightweight computer carrying case (1) has an undulating leaf spring (17) enclosed between two layers of foam. The foam strips and leaf spring are bonded to one another, and the combined spring protection system (15) is surrounded by an aesthetic layer of fabric and mounted in the interior of a main packing compartment. Once snugly fitted betwixt the spring protection device, the computer (23) is strapped in and enjoys superior safety from impact forces, including impacts felt on the corner of the carrying case. The foam is of EVA construction and the leaf spring comprises polypropylene or ABS. A unique and aesthetically pleasing outer pocket with a curving zippered access (29) holds valuables, and a sleeve pocket on the outer front face of the case provides easy access to computer peripherals and such.

25 Claims, 3 Drawing Sheets

U.S. PATENT DOCUMENTS

| | | | | |
|---|---|---|---|---|
| 6,145,661 | A * | 11/2000 | Jung | 206/320 |
| 6,298,991 | B1 | 10/2001 | Tsai | |
| 6,896,134 | B2 * | 5/2005 | Russell et al. | 206/320 |
| 7,549,535 | B2 * | 6/2009 | Pelo | 206/320 |
| 7,631,756 | B2 * | 12/2009 | Picot et al. | 206/320 |
| 2002/0125156 | A1 | 9/2002 | King | |
| 2005/0000996 | A1 | 1/2005 | Petravic | |
| 2005/0284791 | A1 * | 12/2005 | Sadow | 206/522 |
| 2006/0061954 | A1 * | 3/2006 | Lam | 361/685 |
| 2007/0030639 | A1 * | 2/2007 | Ko | 361/685 |
| 2007/0056865 | A1 * | 3/2007 | Pelo | 206/320 |
| 2008/0236077 | A1 * | 10/2008 | O'Reilly | 52/309.8 |

* cited by examiner

LAPTOP COMPUTER CASE AND SPRING PROTECTION SYSTEM

TECHNICAL FIELD

The present embodiment relates to cases particularly designed to carry and protect laptop computers, known as laptop computer carrying cases. More particularly, the disclosed technology relates to the use of springs that are bendable along a flat surface, or leaf springs, for absorbing energy during times of stress or impact to the carrying case.

BACKGROUND

One form of laptop computer protection uses one or two generally flat walls or panels flanking and parallel to the broad faces of the laptop computer and sometimes including a hook & loop strap to help hold the laptop computer's edges and corners away from the rail during impact and thus from direct impact with the rail, even when the case is dropped on a side or corner. Such panel-based isolation systems use a significant portion of the case itself to yield in response to the impact, thus absorbing more of the energy from the impact. This leaves less of the impact energy for the computer itself to absorb. An example of such a system is shown in U.S. Pat. No. 6,655,528, issued to William King of Samsonite Corporation, entitled, "Laptop computer carrying case and impact isolating insert", herein incorporated by reference.

Another example of a laptop computer carrying case that provides computer protection is International Publication Number WO 002/27728, by William King, Elliot Younessian, and Carlo Zezza of Samsonite Corporation, entitled, "Laptop Computer carrying case and impact isolating system therefore", herein incorporated by reference. The isolating system described within WO 002/27728 includes moveable corner supports that are attached to a flanking panel. Hook and loop type fastening elements permit the user the position the corner supports near the center of the flanking panel to protect the computer from impacts from all directions around the case.

A more conventional laptop case construction uses a bumper or buttressing member around the interior of some or all of the rail or perimeter wall that interconnects the flat walls or panels. This bumper has included a layer or layers of synthetic foam rubber alone or contained in a tube formed of some textile material. This bumper has also been constructed of a sealed tube of gas impervious textile filled with a pressurized gas.

DISCLOSURE OF THE INVENTION

A need however still remains to improve impact resistance in computer carrying bags. It would be beneficial to achieve impact resistance to higher, multi-directional forces by more evenly and effectively spreading the energy over the entire case and away from the computer upon impact, but using a lighter, simpler construction.

It is therefore an object of this invention to provide an aesthetically pleasing, lightweight, shock-absorbing system for a laptop computer carrying case that is remarkably effective in protecting the contained laptop computer from impacts in many directions. Accordingly, disclosed is a carrying case for carrying valuable items including laptop computers and the like having side surfaces, a front face and a back face, a thickness dimension extending between the front face and the back face, a maximum dimension extending generally at right angles to the thickness dimension, and the side surfaces bounding the maximum dimension, the carrying case. The carrying case includes a main packing compartment for holding the laptop computer and the like. This main compartment is sized to receive a laptop computer and has a spring encased within foam to act as a shock absorption device, this spring having undulations.

BRIEF DESCRIPTION OF THE DRAWINGS

FIG. 7 is a front view of the case shown in FIG. 1 with an outer flap held open, revealing a front, zippered storage pocket as well as a sleeve panel for storage of computer peripheral accessories and the like.

BEST MODE FOR CARRYING OUT THE INVENTION

Figure 1:
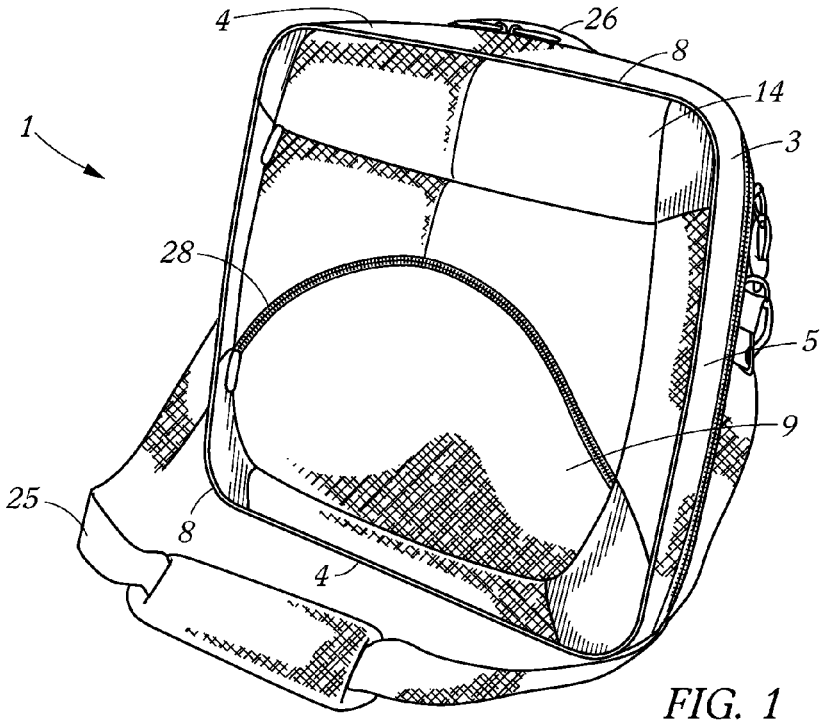
FIG. 1 is a perspective view of the laptop computer carrying case.

The desired objectives may be achieved as illustrated by the following description. The laptop carrying case 1 provides shock absorption to a computer carried therein by providing a unique and highly effective spring protection system 15. The spring protection system 15 comprises an undulating leaf spring 17 sandwiched between two layers of foam 21. This system is located on interior side surfaces 22 of a main packing compartment 2 and cocoons the laptop computer 23.

Except as otherwise detailed below, and except as necessary to accommodate the inventive shock absorbing features, the laptop computer carrying case 1 has a generally conventional construction. FIGS. 1 through 7 show perspective and interior views of the preferred case 1. As shown, a sleek laptop case 1 with an access lid 14 and a removable shoulder strap 25 and retractable carry handle 26 also boasts the effective spring protection system 15 as well as a unique front panel design. Of course, the specific features and design of the present embodiment can vary depending upon its intended use. The exterior of the case 1 comprises a textile and leather-like construction and the interior utilizes standard textiles and liners.

Figure 2:
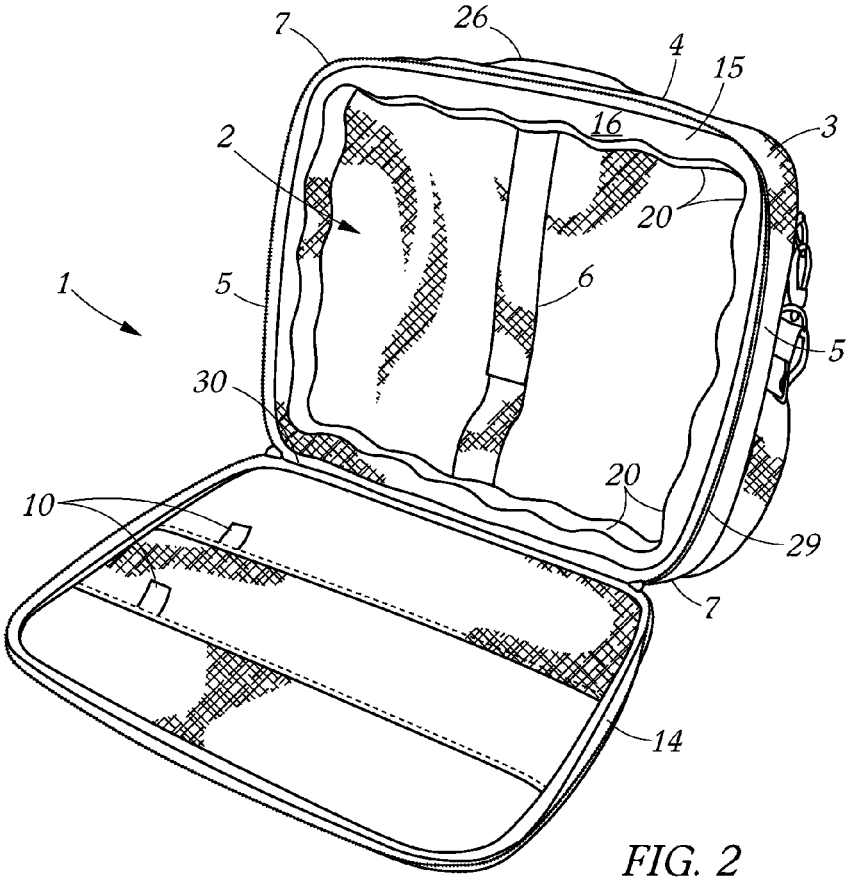
FIG. 2 is an interior view of the case of FIG. 1, showing the main packing compartment and spring protection system wherein the laptop computer is to be stored for transport.
Figure 3:
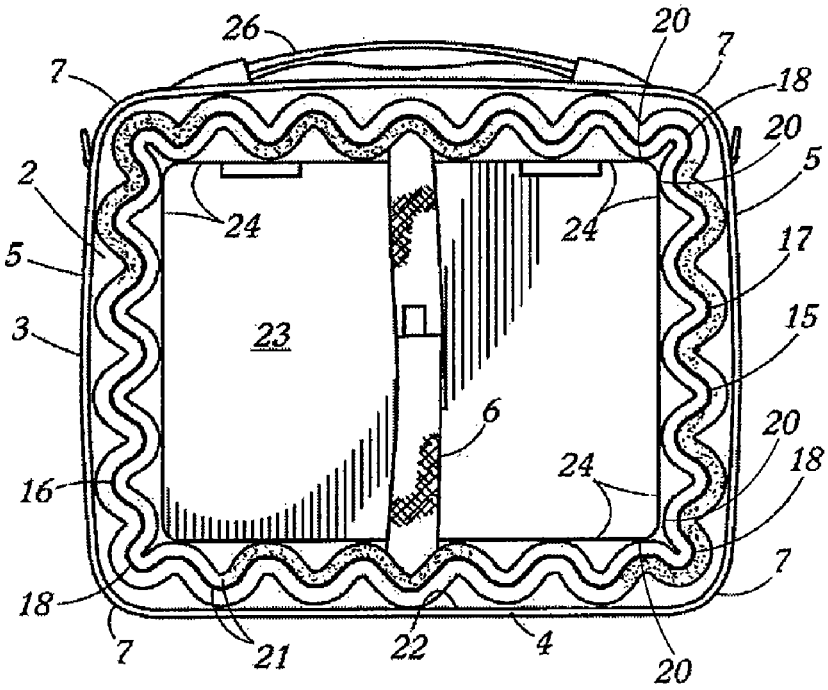
FIG. 3 is an illustration of the main packing compartment of FIG. 2, wherein the spring protection system is shown in cross-section, surrounding a typical laptop computer.

Referring to FIG. 2, the main packing compartment 2 of the preferred case 1 is revealed by a hinge-opening, peripheral zipper 29 having termination along the bottom edge 30 of the case 1. In cross section, as shown in FIG. 3, the spring protection system 15 is defined as an undulating leaf spring 17 surrounded by two layers of foam 21. The spring 17 may be comprised of heat-formed ABS (Acrylonitrile butadiene styrene polymer), which is good for shock absorbance. Of course, the spring may comprise any material suited for molding or thermoforming, and can comprise any dimension, so long as it fits in the case 1 as disclosed. In the present embodiment, the ABS spring has memory such that upon impact, the resiliency inherent in the material restores the spring to its original heat-formed shape. We have found that for most purposes a solid strip of ABS plastic having a thickness of between 0.5 mm and 6 mm, most preferably between 1 mm and 3 mm, should prove ideal. Other polymer materials having similar resilience and memory, such as heat formed polypropylene or polyethylene, could work also.

Figure 4:
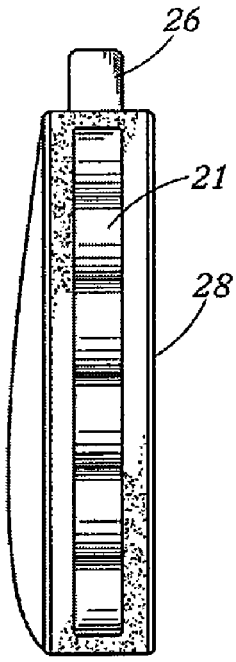
FIG. 4 is a side view of the spring protection system shown in FIG. 3, but with the rail and enveloping textile panels removed to show the system.

The surrounding layers of foam 21 are EVA (Ethylene vinyl acetate) of between 3 and 15 mm thick, preferably between 4 and 12 mm thick. The width of the foam strips 21 should be such that they extend at least as far as the undulating ABS spring 17, and preferably across the entire width of the laptop computer compartment 2, even though the leaf spring portion may be narrower. FIG. 4 shows the EVA foam layers 21 completely spanning the depth of the rail 3 from edge beading 8 to edge beading 8. The layers of EVA are laminated to both sides (the top and bottom flat surfaces) of the ABS spring using a bonding agent or system (not shown). It should be understood by one of ordinary skill in the art that the EVA layers can be bonded or held together by any bonding system and that their proper bonding improves impact resistance.

As stated above, the foam 21 comprises EVA (Ethylene Vinyl Acetate). EVA is a co polymeric member of the polyolefin family derived from random copolymerization of vinyl acetate and ethylene. EVA has many uses, including padding in equipment for various sports such as hockey, boxing, and mixed martial arts, flexible shrink wrap, footwear soles, flexible toys, and so on. Clarity, flexibility, toughness and solvent solubility increase with increasing vinyl acetate content. EVA has little or no odor. It is a polymer that approaches elastomeric materials in softness and flexibility, yet can be processed like other thermoplastics. The material has good clarity and gloss, barrier properties, low-temperature toughness, stress-crack resistance, hot-melt adhesive and heat-sealing properties, and resistance to UV radiation.

The EVA foam strips should have a density of between 20 kg/cubic meter to about 60 kg/cubic meter, most preferably about 22 kg/cubic meter. Other resilient foam materials could be substituted, such as cross-linked polyethylene foam, synthetic foam rubber, foamed rubber polymer mixes, to achieve similar isolation, damping, assembly, cost and weight constraints of the preferred impact isolation system.

The EVA foam/ABS spring/EVA foam comprises 6 waves or undulations along the top and bottom interior sides 22 of the main packing compartment 2, and 5 waves or undulations along the left and right narrow sides 5 of the main packing compartment 2. Although the present embodiment portrays the spring protection system 15 as a singular, continuous, long, relatively flat undulating spring 17 surrounded on both its broad or long sides 4 by continuous lengths of foam 21, the system could include multiple portions like that shown in FIG. 5, that may or may not be affixed to one another or the case 1 itself.

For example, separate, individual spring systems 15 might exist for different portions of the bag and for different applications. The left and right sides and the bottom of the case 1 could enjoy the inventive spring system, for example, while the top portion of the case 1 could be left bare, for example where the laptop case 1 has an opening through the top portion of the rail 3. The spring system can comprise any dimension and overall shape to suit the shape of the bag and/or the needs of the user. For example, for different sized bags, a wider spring system may be employed.

The dimensions of the spring protection system 15, including those of the spring and or of the foam portions, can vary depending upon application. These dimensions can vary within one bag. For example, one could envision a wider spring system along the bottom portion of a computer case while the side and top portions carry a smaller width of spring system. In addition to providing removable spring protection systems, in certain applications it may be desired to bond the spring protection system 15 more securely and intimately with certain portions of the case. For example, it may be beneficial to secure the spring protection system 15, or portions thereof (the foam 21, envelope 16, spring 17, and so on), very securely to the floor of the case. Secure attachment to the case floor may help further protect the computer if the computer's position relative to the spring protection system shifts during transport. This could be achieved with hook and loop fasteners, rivets, glue, sewing methods, and any other method for attachment. Another method of reducing corner impact to the computer includes providing an inwardly extending lip on the distal edges of the width dimension of the spring protection system 15. The lips would curve around the laptop computer 23 at the corners, or along the entire periphery of the computer, to "nest" the computer within the foam/spring protection system.

The nature (density, thickness, depth, length, composition, and so on) of the foam can vary to suit the desired function of the case/carrying bag. A higher density foam may provide more effective shock absorption in a different application. For example, should the spring protection system be used for a larger bag and require the same amount of undulations, a more rigid foam might be desired.

It is of structural significance to provide a continuous leaf spring 17 around the corners 7 of the case 1, wherein the curved portions of the spring protrude outwardly 18 at the corners 7 of the case (see FIGS. 2 and 3). In the event the preferred case 1 is dropped on its corner 7, the waves or undulations of the spring at the corner that protrude outwardly. In contrast with a square corner, these protruding corners 18 likely act as a cradle to the corner regions 24 of the laptop. This cradling effect is achieved by providing at least two points of contact on each side 24 of the laptop corner; these points of contact tend to disperse shock in a sideways direction, away from the corner of the laptop and along the side and bottom lengths of the spring protection system 15, rather than directly into the corner of the laptop.

The combination of spring protection system's components' weights, densities, and dimensions provides the optimum ration between cost, weight savings and impact resistance. This combination of the spring protection system and clean, sleek design enabled by the compactness of the spring system, results in a distinguished, unique computer carrying case.

It should be understood by one of ordinary skill in the art that although the present embodiment focuses on laptop computer carrying cases, the unique spring protection system 15 could be applied to any tote, storage vessel, or case, including backpacks, briefcases, PDA's, MP3 player carriers, purses, suitcases, and so on.

A sample of the preferred construction provided a protection system that yields highly desirable results (optimum shock protection verses weight) when the case is submitted to drop tests. The tested case, constructed as disclosed above, had six waves or undulations along the top and bottom or long sides 4 and 5 along the left and right or narrow sides 5, with a thickness of 1.7 mm, a width of 19 mm, and a wave height or amplitude of about 3 cm. The result is a snug fit around a conventionally sized laptop computer and, most importantly, a tight fit at the corners where the corner of the case meets the corner of the subject spring protection system 15. At the corners, it can be seen in FIG. 3 that the distal waves 20 of the spring protection system's left and right sides in combination with the distal waves of the spring protection system's top and bottom sides almost meet and nearly touch. This orientation provides a large surface area of contact between the spring protection system 15 and the corner regions 24 of the laptop computer. As such, impact forces on the computer corners measured during corner drop tests as summarized in the chart below (see "Dropped on corner of rail") of the test case built according to the detailed description ("Prototype") were very low when compared to competitively priced and sized commercial laptop cases A, B, and C:

Table showing impact force in "g's" measured on simulated laptop computer

| | Prior Art Cases | | | |
|---|---|---|---|---|
| Drop Orientation | A | B | C | Prototype |
| Dropped on long side of rail | 237 | 240 | 198 | 109 |
| | 254 | 207 | 217 | 115 |
| | 226 | | | |
| Dropped on corner of rail | 139 | 173 | 240 | 128 |
| | 131 | 178 | 278 | 157 |
| | | | | 95 |
| | | | | 115 |
| Dropped on narrow side of rail | 406 | 218 | 331 | 181 |
| | 453 | 272 | 378 | 210 |
| | 440 | | | 186 |
| Dropped on back panel | 185 | 145 | 165 | 45 |
| | 204 | 109 | 187 | 48 |

In the comparison testing, each case contained a simulated laptop computer having a mass and dimensions of a typical laptop that would normally be carried in a laptop computer case like the samples tested. In particular, the simulated laptop computer comprised a solid wood block weighing 3150 grams. This block was instrumented with an accelerometer cell firmly affixed to the geometric center of the broad, back surface face of the block. This accelerometer cell measures shock or impact, the output signal of which was translated by instrumentation wired to the cell. The impact force experienced by the wood block is expressed in "g's", or multiples of the acceleration of gravity on Earth at sea level.

The tested cases weighed as follows: Case A=1580 g, Case B=1360 g, Case C=1380 g, and the Prototype=1900 g. Each case had a commercially available shock absorbing system adjacent the entire interior perimeter of the rail, and into which the simulated laptop case was fitted for the drop tests. For Case A, this shock absorbing system had a sandwich of low-density foam, flat polypropylene strip, and low-density foam. Case B had a thick layer of low-density foam. Case C had a double PVC tube, which was sealed to make airtight pneumatic cushion around the perimeter. The thus loaded and instrumented cases were allowed to drop freely from a measured height, impacting the noted portion of the case onto a simulated floor surface. For the corner drop tests, this height was 60 cm, for the other three types of tests, the height was 80 cm. The semi rigid nature of the EVA foam in combination with the undulating leaf spring apparently helps to apply and retain a more uniform compression to the computer, as well as a better method of energy absorption upon impact to the case, especially to its corners. In another embodiment, a spring protection system having a width greater than that of the walls of the interior packing compartment 2, combined with a peripheral zipper could also increase the degree of snugness by which the computer is stored.

Figure 5:
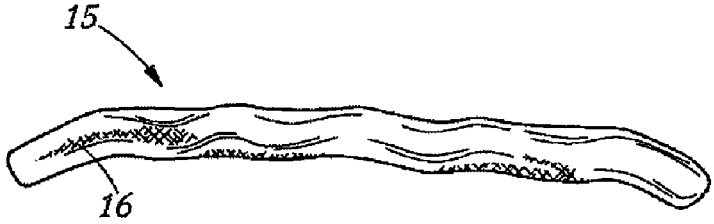
FIG. 5 is a close-up view of a simplified version of the spring protection system of FIG. 2.
Figure 6:
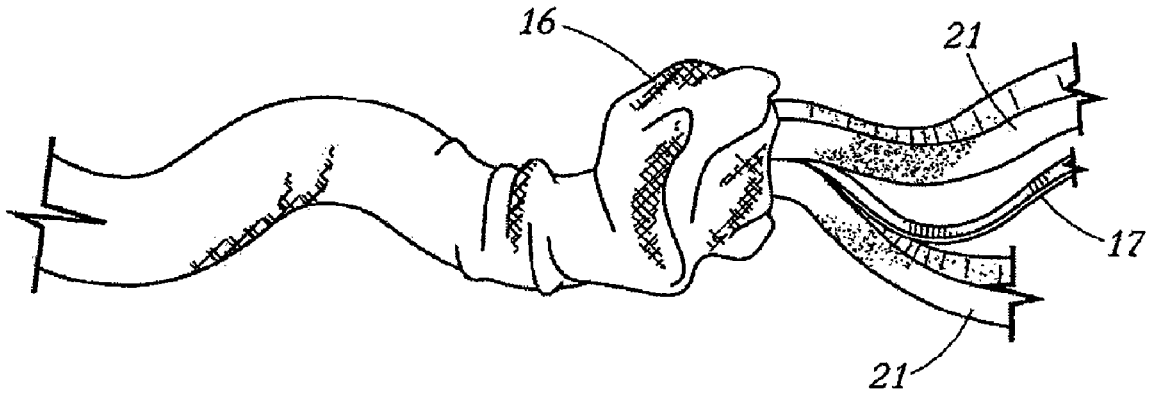
FIG. 6 is a close-up view of the spring protection system of FIG. 5 wherein an enveloping layer of textile is pulled back to expose details of the spring protection system.

As shown in FIG. 5, the spring protection system outline can be seen through a snug protective textile envelope 16. The aesthetic textile envelope that surrounds the spring protection system is pulled back in FIG. 6, revealing the combination of the undulating leaf spring with two layers of foam 21. The envelope fabric may include any fabric suitable for the purposes of the present embodiment, including fabric having water-resistant properties, design features such as unique texture or ornamental designs, functional features such as additional strap housings, pockets, organizational pouches, and so on. The spring protection is fastened to the main packing compartment 2 by attaching its enveloping fabric to the rail interior of the main packing compartment 2. This is done by sewing the protective envelope to a sheet of polypropylene that is attached to and traverses the inner surfaces of the main packing compartment walls all along the packing compartment's periphery. Of course, other means of attaching the spring protection system could be envisioned. For example, the polypropylene sheet could be replaced by any material, if present at all, including semi-rigid fabric, textile, or other fabric. The envelope could be attached to the case by any means including glue, snaps, rivets, slide fastener (zip), and so on.

Although in the present embodiment the envelope is attached to the main compartment, further variations could be made. The spring protection system itself could be affixed to portions of the inner surfaces of the innovative case. In contrast to simply attaching the system by attaching its enveloping textile portion 16 to the bag, the foam itself could be attached to the packing compartment as well. For example, the foam could be stapled, glued, sewn, riveted, or attached by any other means to the case in addition to the attaching of its surrounding envelope to the bag.

Conversely, the spring protection system may remain entirely or partially independent from the rest of the case. For example, while the preferred embodiment employs lid-opening access to the protected laptop compartment, other applications of the disclosed shock isolation system could easily be constructed. One such application could employ a briefbag construction with a top-loading laptop compartment, wherein access to the compartment is gained through or at a top edge of the bag, near a carry handle or shoulder strap. The peripheral isolation system would fit snugly within the rail portion of the compartment, lining the bottom and side portions in an overall "U" shape. The rail portion may comprise a narrow textile (and metal or polymer frame, if any) construction defining the depth dimension between the front panel and back panel 28 of the bag. This isolation system could be built into the rail construction, or it could be made as an aftermarket accessory. The isolation system could be attached to the inside surface of the rail portion, using any means of attachment, including hook and loop fasteners, snaps, straps, and so on.

Of course, it should be understood by one of ordinary skill in the art that the material of any component of the case including the bonded foam, the handles, the body fabric, and so on, can comprise any material, including textile, polymer, EVA that is of a more rigid nature, a semi-rigid or rigid material, or any other material. Any foam, including memory foam, could be used in the construction of the components of the case; for example, an additional strip of memory foam could be applied along the bottom of the main packing compartment to further protect the bottom edge of the laptop.

Referring to FIG. 3, a securing strap 6 is shown to hold the laptop computer 23 firmly in place and to prevent lateral, or front-to-back motion of the computer. Of course, other redundant securing means could be employed, like a bungee pocket, additional or crossing straps, and so on.

Figure 7:
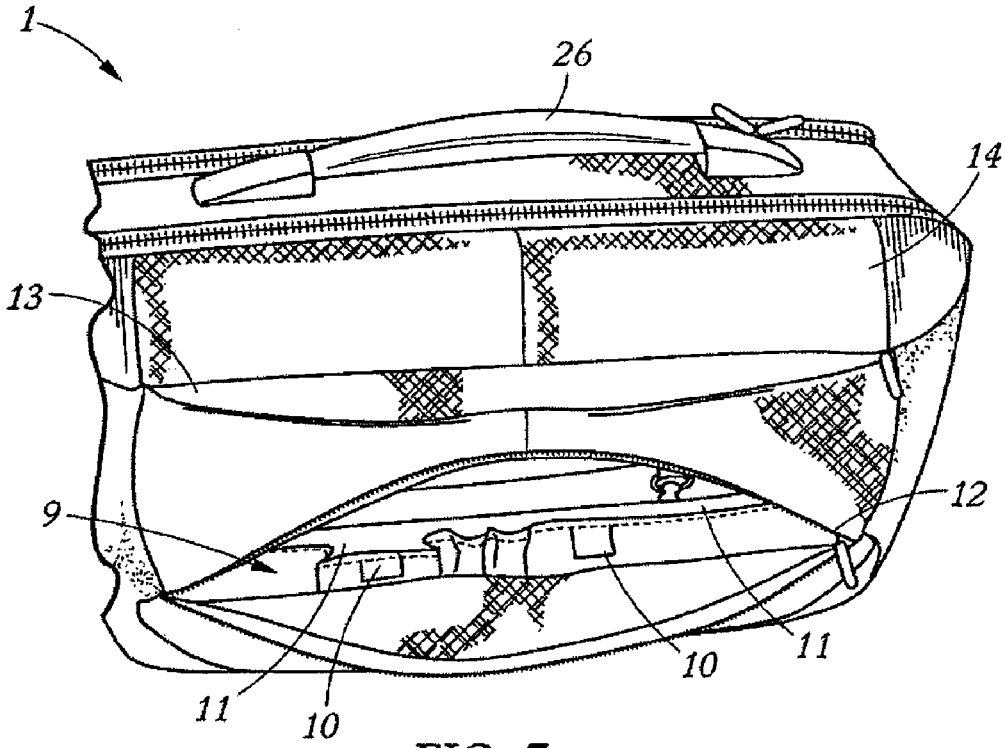

The front panel is of unique construction. Referring to FIGS. 1 and 7, a downwardly curving access to a pouch 9, secured by a zipper 12, is shown. Inside, the pouch 9 can store multiple necessary items (cell phone, keys, wallet, and so on) and provides visual tabs 10 to quickly locate the appropriately sized pockets 11 for such items. The front panel also provides a full-sized pouch in the form of an open, "sleeve" pocket 13. Access is easily gained by flipping open the lid, which may be secured by a hook and loop fastener tab or other securing mechanism, and simply slipping a hand inside.

Although the present embodiment been described with a certain degree of particularity, it is understood that the present disclosure has been made by way of example, and changes in detail or structure may be made without departing from the spirit of the invention as defined in the appended claims.

What is claimed is:

1. A carrying case for carrying valuable items including laptop computers and the like, the carrying case comprising a main packing compartment sized to receive and contain a laptop computer, the main packing compartment including a spring encased within foam to act as a shock absorption device, said spring including a plurality of undulations, and said foam including a plurality of undulations that encase and conform to the undulations of said spring.

2. The carrying case of claim 1 wherein the spring extends around the periphery of the main packing compartment.

3. The carrying case of claim 1 wherein the spring is a single continuous resilient piece.

4. The carrying case of claim 1 wherein the spring comprises a leaf spring.

5. The carrying case of claim 1 wherein the foam comprises two continuous layers, and said spring is sandwiched between the two continuous layers of foam.

6. The carrying case of claim 1 wherein the spring and the foam are removable from the main packing compartment.

7. The carrying case of claim 1 wherein the undulations of the spring protrude outwardly at corners of the main packing compartment to provide additional shock absorption.

8. The carrying case of claim 1 wherein the spring comprises six undulations along an interior edge of the main packing compartment.

9. The carrying case of claim 1 wherein the spring comprises five undulations along an interior edge of the main packing compartment.

10. The carrying case of claim 1 wherein the foam is comprised of ethylene vinyl acetate.

11. The carrying case of claim 1 wherein the foam is comprised of two layers of foam each with a thickness of between 3 mm and 15 mm.

12. The carrying case of claim 1 wherein the spring is comprised of a polymer selected from a group including polypropylene, polyethylene or acrylonitrile butadiene styrene.

13. The carrying case of claim 1 wherein the spring includes a thickness of between 0.5 mm and 6 mm.

14. The carrying case of claim 1 wherein the spring and the foam are surrounded by a fabric envelope.

15. The carrying case of claim 14 wherein the fabric envelope, the spring and the foam are simultaneously and readily removable from the carrying case.

16. The carrying case of claim 1 wherein the spring and the foam are formed to define a shape that generally conforms to the shape of the laptop computer carried therein.

17. The carrying case of claim 1 wherein the spring and the foam are sized to provide a substantially tight fit around the peripheral of the laptop computer carried therein.

18. The carrying case of claim 1 wherein the spring includes top, bottom, right and left sides that generally define a rectangle, and at corner portions of the spring, the undulations of the spring that are located on the top and bottom sides of the spring almost touch the undulations of the spring that are located on the left and right sides of the spring.

19. The carrying case of claim 18 wherein the spring is continuous at the corner portions of the rectangle.

20. The carrying case of claim 18 wherein each of the top, bottom, left and right sides of the spring comprises a width dimension perpendicular to the undulations of the spring, and at least one of the width dimensions is different from at least one of the other width dimensions.

21. The carrying case of claim 1 wherein the spring forms a continuous closed loop.

22. The carrying case of claim 1 wherein the foam forms a continuous closed loop.

23. The carrying case of claim 1 wherein the spring and the foam are configured to form at least one undulation at a corner of the main packing compartment, the at least one undulation comprises a first portion and a second portion that define an outwardly protruding structure, and sections of the first and second portions of the at least one undulation almost touch each other.

24. The carrying case of claim 23 when an item is received within the main packing compartment, the at least one undulation touches two different sides of the item received within the main packing compartment.

25. The carrying case of claim 24 wherein the two different sides of the item received within the main packing compartment converge to form a corner, and the at least one undulation provides a substantially tight fit around the corner of the item received within the main packing compartment.

* * * * *

UNITED STATES PATENT AND TRADEMARK OFFICE

CERTIFICATE OF CORRECTION

PATENT NO. : 8,353,400 B2
APPLICATION NO. : 12/522156
DATED : January 15, 2013
INVENTOR(S) : Santy et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 614 days.

Signed and Sealed this
First Day of September, 2015

Michelle K. Lee

Michelle K. Lee
*Director of the United States Patent and Trademark Office*